US005839595A

United States Patent [19]

Ujita

[11] Patent Number: 5,839,595

[45] Date of Patent: Nov. 24, 1998

[54] INK CONTAINER AND MANUFACTURING METHOD THEREFOR

[75] Inventor: Toshihiko Ujita, Yokohama, Japan

[73] Assignee: Canon Kabushiki Kaisha, Tokyo, Japan

[21] Appl. No.: 604,561

[22] Filed: Feb. 21, 1996

[30] Foreign Application Priority Data

Feb. 21, 1995 [JP] Japan ..... 7-031274

[51] Int. Cl.[6] ..... B65D 73/00

[52] U.S. Cl. ..... 220/4.21; 347/86; 347/87

[58] Field of Search ..... 220/23.93, 4.26, 220/4.23, 4.21, 4.24; 347/86, 87; 346/140.1

[56] References Cited

U.S. PATENT DOCUMENTS

| | | | |
|---|---|---|---|
| 3,586,162 | 6/1971 | Townsend | 220/4.24 X |
| 4,607,261 | 8/1986 | McCann et al. | 347/86 |
| 5,138,344 | 8/1992 | Ujita | 346/140 |
| 5,182,581 | 1/1993 | Kashimura et al. | 347/87 |
| 5,237,342 | 8/1993 | Saikawa | 347/87 |
| 5,400,066 | 3/1995 | Matsumoto et al. | 347/86 |
| 5,430,471 | 7/1995 | Nakajima et al. | 347/87 |
| 5,448,818 | 9/1995 | Scheffelin et al. | 347/86 X |
| 5,477,963 | 12/1995 | Mochizuki et al. | 347/86 X |
| 5,552,816 | 9/1996 | Oda et al. | 347/86 |

*Primary Examiner*—Steven M. Pollard
*Attorney, Agent, or Firm*—Fitzpatrick, Cella, Harper & Scinto

[57] ABSTRACT

An ink container for storing the ink to be supplied to an ink jet head includes an ink container shell having at least a first and a second shell portion; a porous member disposed in the ink container, having a first and a second porous member portion which are disposed within the first and the second portion, respectively; wherein the first shell portion containing the first porous member portion is provided with an ink supplying portion, at which the ink container is connected to the ink jet head; and the second container shell portion containing the second porous member portion is provided with an air vent; and the first and the second container shell portion are joined to form the ink container.

5 Claims, 6 Drawing Sheets

INK CONTAINER AND MANUFACTURING METHOD THEREFOR

FIELD OF THE INVENTION AND RELATED ART

The present invention relates to an ink container for holding a type of ink which is used as a recording agent for an ink jet recording apparatus, and the production method for such a type of ink.

In recent years, there has been a growing demand that the size of a recording apparatus such as an ink jet recording apparatus which employs liquid ink as a recording agent be reduced.

It is quite natural that reducing the recording apparatus size results in reducing the size of the ink container itself. Since the amount of ink needed by a recording means for finishing a given amount of recording material remains the same regardless of the apparatus size, reduction of the ink container size means more frequent replacement of the ink container. Therefore, the utilization ratio for the ink contained in the ink container must be improved as much as possible in consideration of running (operating) cost.

In the past, porous material such as sponge which contains continuous pores has been widely employed as means for holding the ink. This is because the capillarity provided by the porous material can be easily controlled by varying the pore size or compression ratio so that a recording head is provided with a proper amount of negative pressure for releasing an appropriate amount of ink, and also, because usage of porous material allows the ink container structure to be simplified, and therefore, the ink container can be relatively inexpensively manufactured.

Not only must the ink container employing the material containing continuous pores be reduced in size, but also, it must be shaped to fit in the space within an ink jet printer while increasing the initial ratio of ink to ink container capacity.

FIG. 1 is an exploded, schematic, perspective view of such an ink container, showing the shape compatible with the aforementioned space within an ink jet printer. As is evident from FIG. 1, the shell of an ink container 82 has a stepped portion which divides the ink container 82 into a portion 82*a* with a larger volume, and a portion 82*b* with a smaller volume. This configuration increases the ink capacity while effectively utilizing the internal space of the apparatus.

The ink container 82, to which a head 81 is joined, further comprises a lid 84 and a piece of sponge 83. The lid covers the top opening of the ink container 82, and the sponge piece 83 is sealed within the ink container shell by the lid 84. Generally speaking, the head 81 and the ink container 82 are formed by molding; therefore, it is relatively easy to give them the aforementioned configurations.

However, when an attempt is made to insert the simple cubical piece of sponge 83, which is generally easy to mass-produce, into the ink container 82 having the aforementioned complicated shape, the sponge piece 83 fails to conform to the shape of the ink container 82, at the stepped portion. As a result, a dead space, with respect to ink retention, is formed in the ink container, reducing the initial ratio of ink to ink container capacity.

Therefore, it is conceivable, as a solution to the problem of the dead space, to process the sponge 83 by cutting it a few times to match its shape to the shape of the internal space of the ink container 82 as shown in FIG. 1, and then, place it in the ink container 82. However, such a process is extremely complicated and difficult to perform, and if performed, the cost becomes extremely high.

SUMMARY OF THE INVENTION

The present invention was made in consideration of the problems of the aforementioned technology, and its primary object is to provide an ink container, which is elaborately shaped to conform to the mandatory shape of the ink container; does not have the dead space, offering an improved initial ratio of ink to ink container capacity; and can be simply and inexpensively produced.

According to an aspect of the present invention, an ink container for storing the ink to be supplied to an ink jet head comprises: an ink container shell constituted of a minimum of a first and a second shell portion; a porous member disposed in the ink container, being constituted of a first and a second porous member portion which are disposed within the first and the second portion, respectively; wherein the first shell portion containing the first porous member portion is provided with an ink reception portion, at which the ink container is connected to the ink jet head; the second container shell portion containing the second porous member portion is provided with an air vent; and the first and the second container shell portion are joined to form the ink container.

According to another aspect of the present invention, a method for manufacturing the ink container for storing the ink to be supplied to an ink jet head comprises: a step for preparing the first and the second ink container shell portion which constitute the ink container, each of the first and he second ink container shell portion being provided with a space capable of accommodating a corresponding portion of the porous member; a step for preparing the first and the second porous member portion and disposing them into the first and the second ink container shell portion, respectively; and a step for joining the first and the second ink container shell portion.

According to the present invention, the ink container shell is divided into portions with a simple shape, and an absorbent member with a simple shape matching the simple shape of each of the divided portions is inserted in the corresponding divided portion: therefore, the dead space in the ink container is eliminated.

Further, the size and configuration of the absorbing member is such that at least a portion of the absorbent member protrudes from the opening of the structural component of the ink container during an interim period of the ink container assembly process. Therefore, the absorbent member in the finished ink container remains compressed, and its resiliency further reduces the dead space.

Further, the ink container of a complex shape can be produced by connecting plural ink container shell portions with a simple shape, regardless of the complexity of the ink container shape.

Further, the internal surface of the ink container, which comes in contact with the absorbent member, is roughened to prevent the absorbent member, which is temporarily placed in the ink container shell portion, from shifting out of the opening of the ink container shell portion during the interim period of the assembly process; therefore, it is assured that the absorbent member (sponge piece) remains in a preferable state in the ink container shell portion.

Further, the process of inserting the absorbent member is carried out through plural stages, and is repeated a few times; therefore, the proper insertion of the absorbent member is guaranteed.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the preferable embodiments of the present invention will be described with reference to the drawings.

Embodiment 1

Figure 1:
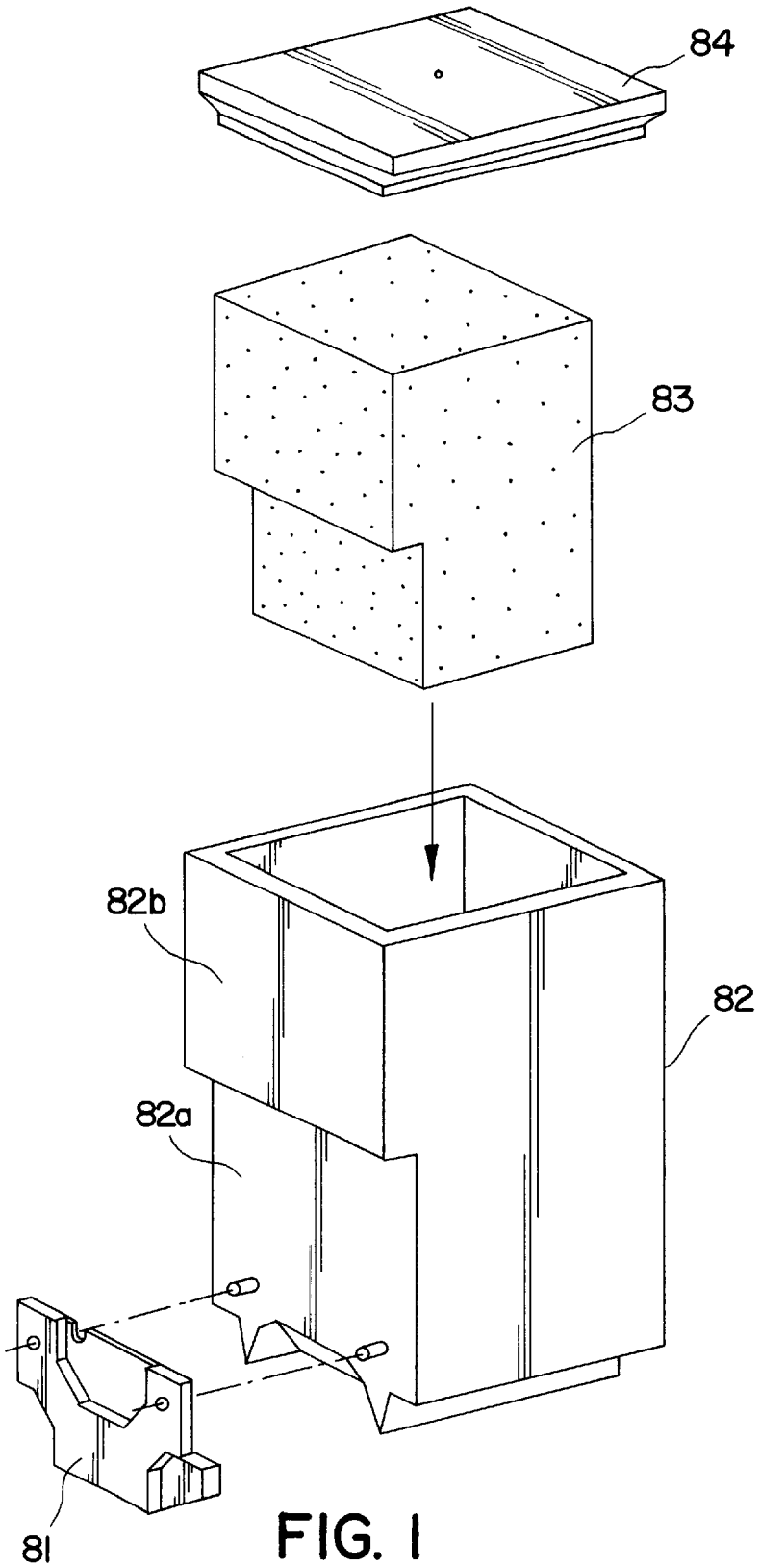
FIG. 1 is an exploded schematic perspective view of a typical conventional ink container.
Figure 2:
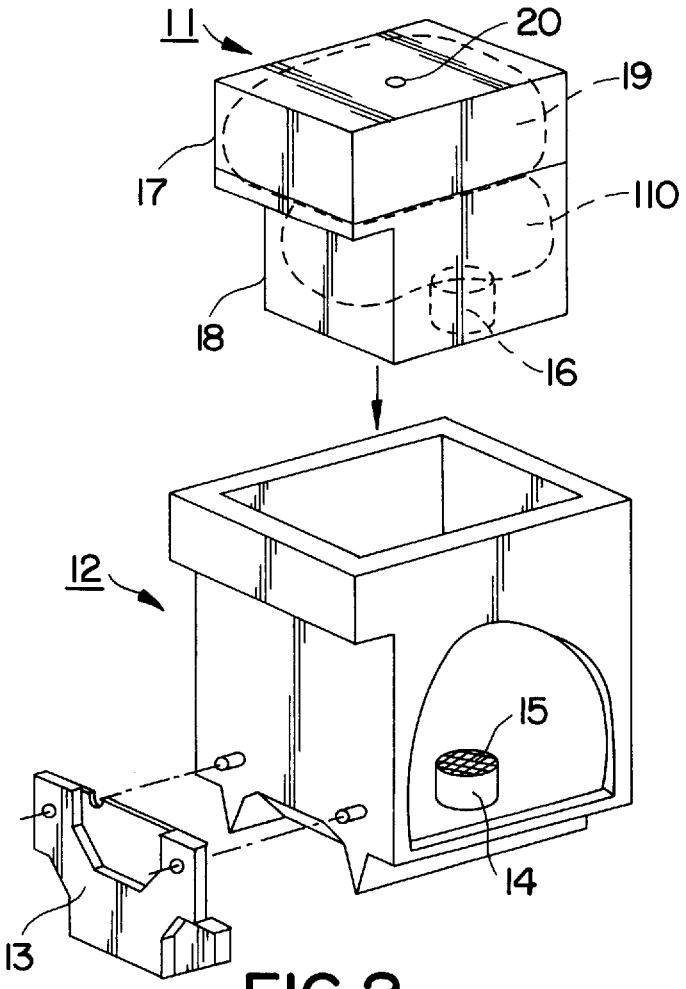
FIG. 2 is an exploded schematic perspective view of the ink container in the first embodiment of the present invention, and the holder in which the ink container is mounted.

FIG. 2 is an exploded, schematic, perspective view of the ink container 11, and the ink container holder 12 for holding the ink container 11, in the first embodiment of the present invention. In this drawing, an ink jet recording head 13 which is to be joined with the ink container 11 is shown, being separated from the ink container 11. The ink container 11 in this embodiment is inserted into the ink container holder 12 as shown in FIG. 12, and the ink jet recording head 13 is attached to the ink container holder 12. The ink container 11 and tile ink container holder 13 are separable from each other.

An ink reception port 14 which is shaped 1like a cylindrical chimney is located within the ink container holder 12, and a compressible member 16 as an ink delivery member is disposed within the ink container 11, at a location correspondent to the locations of the ink reception port 14. The ink reception port 14 is provided with a filter 15. As the ink reception port 14 and the compressible member 16 are pressed to each other, with the filter 15 interposed, an ink path is formed, and the ink is supplied to the recording head due to the capillary force generated on both sides. The compressible member 16 is constituted of fine strands of fibers bundled together.

One of the vertical walls of the ink container 11 is stepped. This is because the ink container 11 is formed by joining a first ink container portion 17 having a bottom opening, and a second ink container portion 18 having a top opening, aligning their openings. Each of the ink container portions 17 and 18 is filled with pieces of sponge 19 and 110, which are compressed into the ink container portions 17 and 18, respectively. The aforementioned compressible member 16 is disposed within the second ink container portion 18. The top wall of the first ink container portion 17 is provided with an air vent 20.

Figure 3:
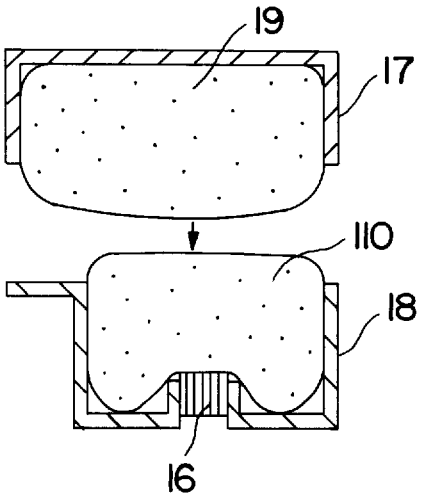
FIG. 3 is a sectional view of the ink container in the first embodiment of the present invention, depicting the state of the ink container before it is joined with the holder.

Referring to FIG. 3, the sponge pieces 19 and 110 are inserted into the correspondent ink container portions 17 and 18 before joining the ink container portions 17 and 18. After the insertion, they bulge vertically and horizontally above the openings of the ink container portions 17 and 18. Next, referring to FIG. 4, after the ink container portions 17 and 18 are joined, the sponge pieces 19 and 110 remain compressed. With this arrangement, the sponge pieces 19 and 110 have only to be given the simplest configurations that conform to the configurations of the internal spaces of the ink container portions 17 and 18, respectively.

Therefore, the configuration of the ink container can be designed without considering the matter of sponge piece production.

Figure 4:
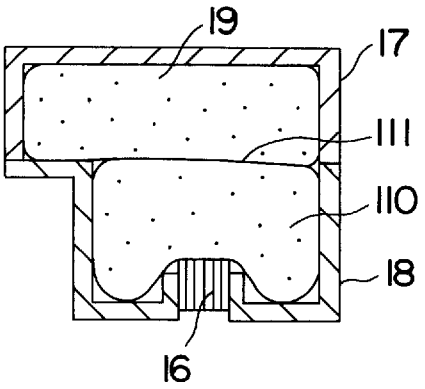
FIG. 4 is a sectional view of the ink container in the first embodiment of the present invention, depicting the state of the ink container after it is joined with the holder.

Regarding means for joining the ink container portions 17 and 18 as illustrated in FIG. 4, gluing, ultrasonic welding, heat welding, or the like, are employed to render the joint completely sealed. As the ink container portions 17 and 18 are joined, the sponge pieces 19 and 119 having been inserted therein are united as an ink holding portion comprising an interface 111 formed between the two pieces of sponge. The sponge becomes highly compressed adjacent to the interface 111, but this highly compressed state of the sponge does not deteriorate ink delivery, allowing the ink to be preferably delivered, since the compression ratio of the sponge between the interface 111 and the compressible member 16 becomes even higher due to the inward protrusion of the compressible member 16.

Embodiment 2

Figure 5:
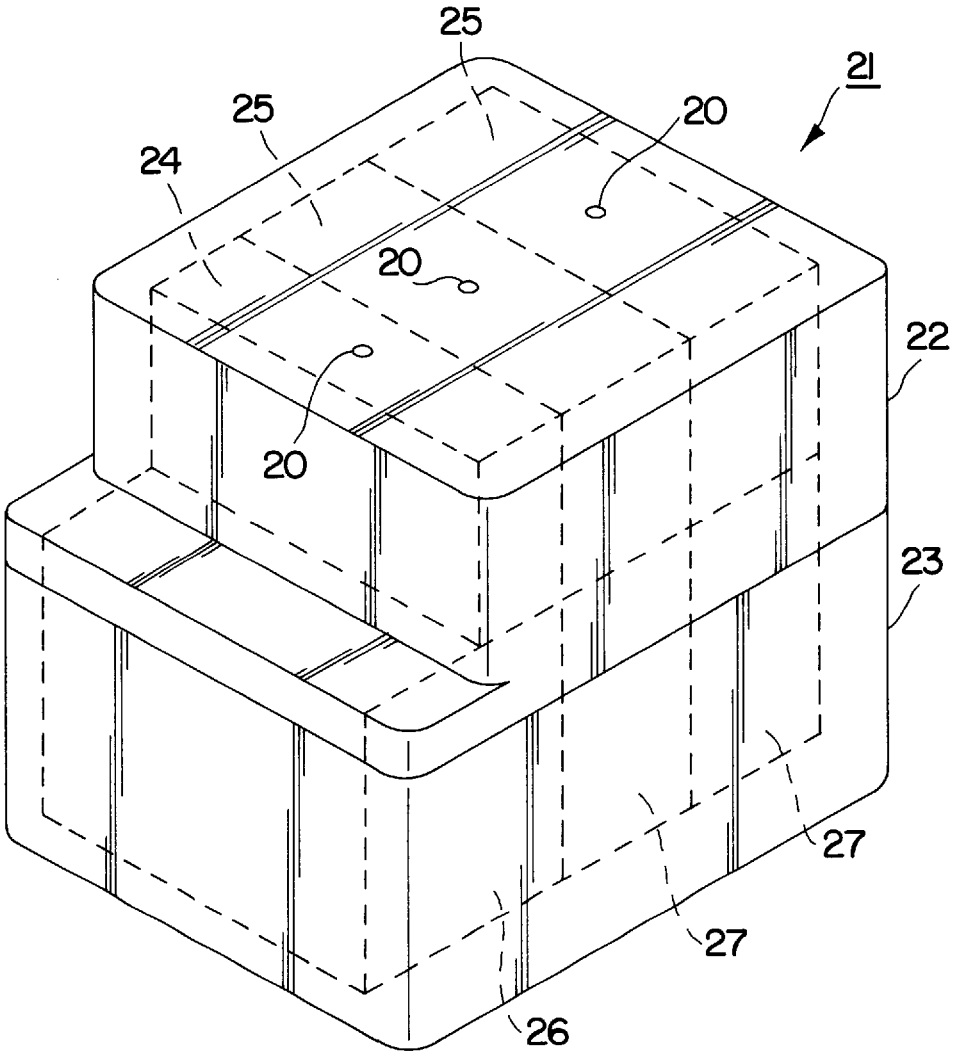
FIG. 5 is a schematic perspective view of the ink container in the second embodiment of the present invention.
Figure 6:
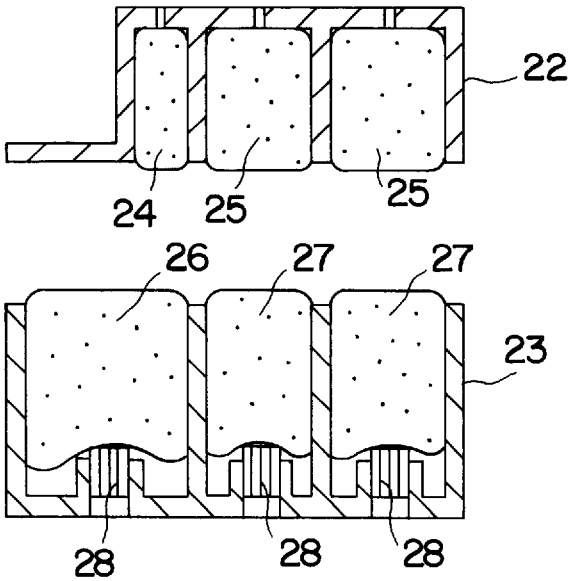
FIG. 6 is a sectional view of the ink container in the second embodiment of the present invention, depicting the state of the ink container before it is joined with the holder.
Figure 7:
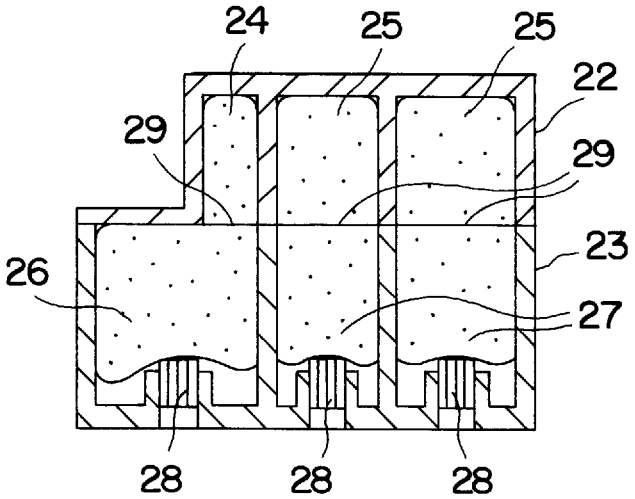
FIG. 7 is a sectional view of the ink container in the second embodiment of the present invention, depicting the state of the ink container after it is joined with the holder.
Figure 8A:
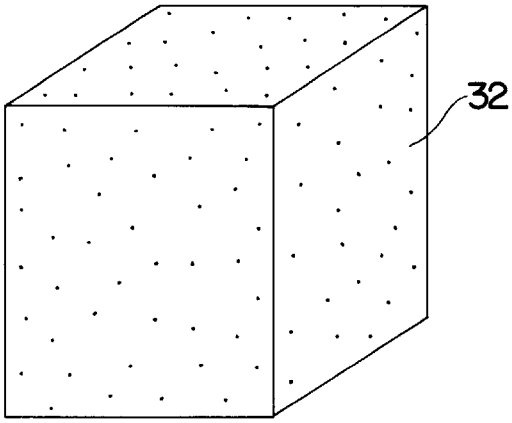
FIGS. 8(*a–e*) are schematic drawings describing the steps for inserting the sponge.
Figure 8B:
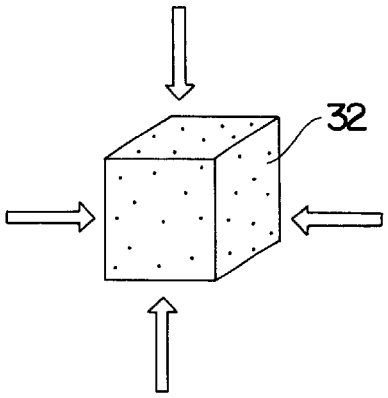
Figure 8C:
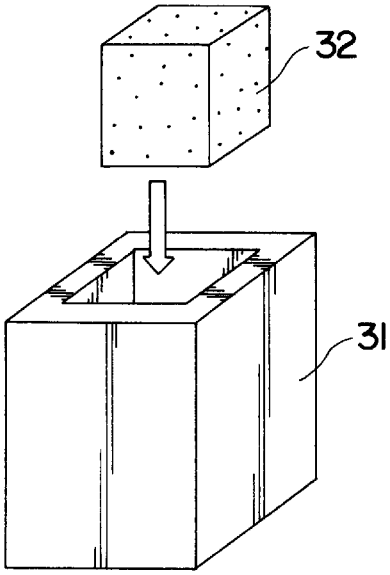
Figure 8D:
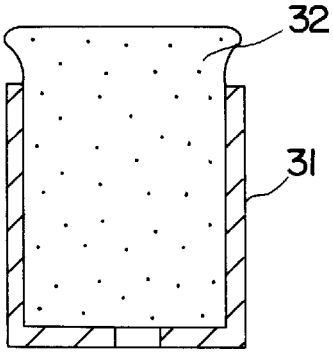
Figure 8E:
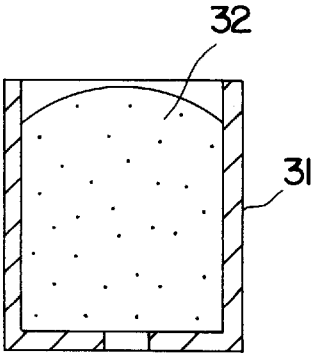

FIGS. 5–7 depict the second embodiment of the present invention.

This embodiment is fundamentally the same as the first one, except for the ink container structure. FIG. 5 is an external perspective view of the ink container alone, depicting its structure and how the ink container components fit together. FIG. 6 is a sectional view of the ink container, depicting the state of the ink container before the ink container components are assembled, and FIG. 7 is a sectional view of the ink container, depicting the state of the ink container after the ink container components are assembled.

The ink container 21 in this embodiment holds three types of ink at the same time. Accordingly, the internal spaces of the first and second ink container portions 22 and 23 of the ink container 21 are partitioned into three chambers, and the compressible member 28 i s disposed in each of the three chambers of the second ink container portion 23.

The configurations of the aforementioned three chambers formed by partitioning the ink container portions 22 and 23 are not necessarily the same since they must be shaped to conform to the overall configuration of the ink container 21. More specifically, among the three chambers of each of the ink container portions 22 and 23, the configuration of the leftmost chamber is different from those of the other two, and accordingly, pieces of sponges 24 and 26 to be placed in the leftmost chamber are shaped differently from pieces of sponges 25 and 27 to be placed in the other two chambers.

These sponge pieces 24–27 are thermally shrunk in advance; therefore, it is unnecessary to compress them when they are inserted into the ink container portions 22 and 23. Also in this embodiment, each of the sponge pieces 24–27 is designed to protrude from the opening of the corresponding ink container portion, and is inserted into the corresponding chamber as illustrated in FIG. 6. Next, the ink container portions 22 and 23 filled with the sponge piece are joined together by means such as gluing, ultrasonic welding, heat welding, or the like, rendering the joint completely sealed. The each of three pairs of sponge pieces confined in their own chambers forms an interface 29, and integrally functions as a single piece of ink holding portions.

Embodiment 3

Next, the third embodiment of the present invention will be described.

As described in the preceding embodiments, in order to be sure that the sponge piece having been inserted in each of the plural ink container portions makes preferable contact with corresponding sponge piece while the ink container is assembled, the sponge piece must be projecting above the opening of each container portion before the ink container is assembled. Further, the sponge piece must be inserted so as not to create adverse effects when the ink container portions are joined.

A means for inserting the sponge pieces to create the condition described above will be described below.

When a sponge piece 32 illustrated in FIG. 8(*a*) is compressed into an ink container portion 31 illustrated in FIG. 8(*c*), attention must be paid so that the sponge piece 32 is entirely compressed into the ink container portion 31 to prevent the sponge piece 32 from partially bulging outward, vertically as well as horizontally as illustrated in FIG. 8(*d*), beyond the rim of the ink container 32, that is, the inward edge of the surface to be welded.

After the sponge piece 32 is compressed into the ink container portion 31, the periphery of the sponge piece 32, which is in contact with the internal wall surfaces of the ink container portion 31, remain below the center portion of the sponge piece 32 due to the contact resistance. In the preceding first and second embodiments, the sponge piece portion bulging out of the ink container portion 31 is preferable to be as large as possible, and the top end of the interface between the sponge piece 32 and the internal wall surface of the ink container portion 31 is preferable to be as close as possible to, or exactly at the rim of the ink container portion 31, so that the surface of the sponge piece 32 is placed in full contact with the counterpart. Traditionally, the above described condition of the sponge pieces 32 has been created only by controlling the pressure applied to compress the sponge piece 32 into the ink container portion 31.

This traditional method, however, makes it extremely difficult to place the sponge piece 32 in such a manner as to achieve the expected condition of the contact between the sponge pieces. Also, when the sponge piece 32 is not inserted far enough, it budges out vertically as well as horizontally beyond the rim of the ink container portion 31 as illustrated in FIG. 8(*d*), adversely affecting the assembly process.

This third embodiment of the present invention, which eliminates the above described inconveniences of the traditional method, will be described below, with reference to FIG. 9.

Figure 9A:
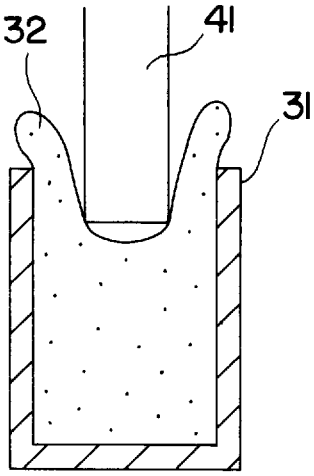
FIGS. 9(*a–c*) are schematic drawings describing different steps for inserting the sponge.
Figure 9B:
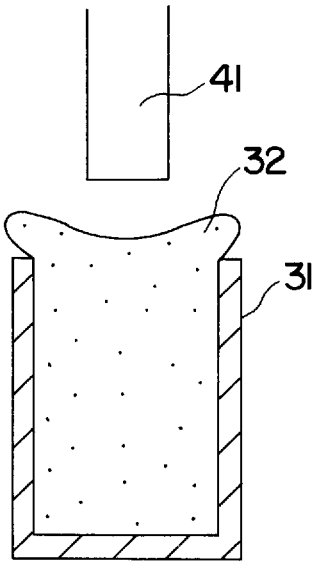
Figure 9C:
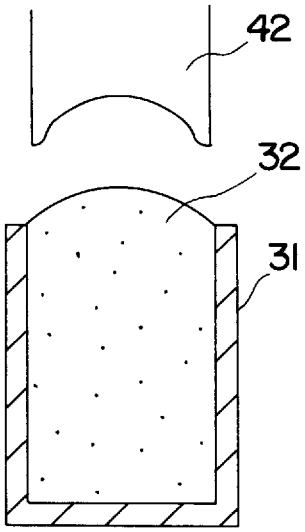

As illustrated in FIGS. 9(*a*) and 9(*b*), in this embodiment, a first compression jig 41, the compression surface of which is smaller in size than the opening of the ink container portion 31, is initially used to compress the sponge piece 32 into the ink container portion 31. Thereafter, a second compression jig 42, the compression surface of which is substantially the same in size as the opening of the ink container portion 31, and is concaved, as illustrated in FIG. 9(*c*), is used to compress the sponge piece 32 further into the ink container portion 31.

More specifically, the above described sponge piece compressing process consists of a first and a second stage. In the first stage, the sponge piece 32 is relatively gently compressed with the first compressing jig 41, leaving a part of the sponge piece 32 protruding from the opening of the ink container portion 32, vertically as well as horizontally. The second stage is a re-compression stage for selectively compressing into the ink container portion 31, the portion of the sponge pieces 31, which is horizontally bulging from the opening of the ink container portion 31, beyond its rim. As for the jig to be used in this re-compression stage, the first compression jig 41 used in the first stage may be used, but when the second compression jig 42, the size and configuration of which are matched to the size and configuration of the ink container portion 31, is used, the sponge piece 32 can be more ideally inserted. Incidentally, the second compression stage may be repeated.

Embodiment 4

Figure 10A:
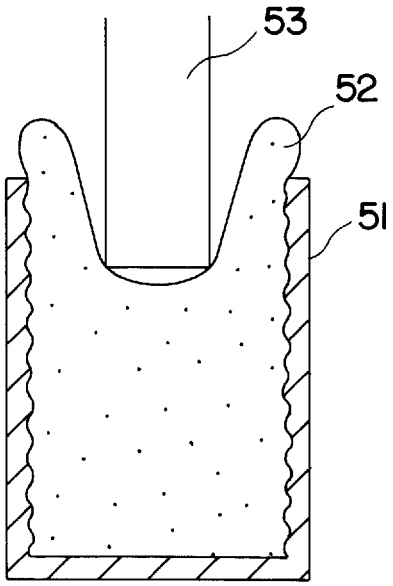
FIGS. 10(*a–b*) are schematic drawing describing different steps for inserting the sponge.
Figure 10B:
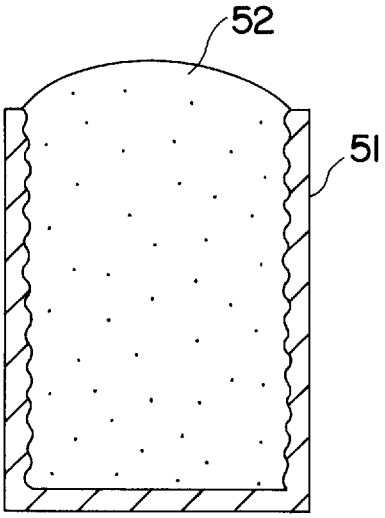

FIG. 10 is a sectional view of the ink container portion and the sponge piece in the fourth embodiment of the present invention In this embodiment, in order to stabilize the condition of the sponge piece after its insertion, the roughness of the internal surface of the ink container portion is increased.

After the sponge pieces are ideally inserted in the ink container portions as described in the third embodiment, the ink container portions are welded together. The welding process must be swiftly carried out immediately after the sponge piece inserting process. This is because sponge displays ample resiliency to restore its original shape and volume, and therefore, the ideal shape of the compressed sponge is liable to be quickly lost.

In this embodiment, the roughness of the internal wall surface of the ink container portion 51 is set in a range of a roughness of 35S to a roughness of 560S. As a result, the sponge piece 52 having been compressed into the ink container portion 51 with a compression jig 53 as shown in FIG. 10(*a*) remains in a stable condition, as illustrated in FIG. 10(*b*), due to the friction between the sponge piece 52 and the roughened internal wall surface of the ink container portion 51. Consequently, it becomes unnecessary to control the condition of the compressively inserted sponge piece during the ink container production, making it possible to produce a stable and inexpensive ink container.

While the invention has been described with reference to the structures disclosed herein, it is not confined to the details set forth, and this application is intended to cover such modifications or changes as may come within the purposes of the improvements or the scope of the following claims.

What is claimed is:

1. An ink container for storing the ink to be supplied to an ink jet head, comprising:

an ink container shell having at least a first shell portion and a second shell portion;

first and second porous members disposed in said ink container, said first and second porous members being separate members contacted to each other, and being disposed respectively within the first shell portion and the second shell portion, the first porous member and the second porous member containing the ink to be supplied to the ink jet head;

wherein the first shell portion containing the first porous member is provided with an ink supplying portion, at which said ink container is connected to the ink jet head;

wherein the second shell portion containing the second porous member is provided with an air vent; and wherein the first shell portion and the second shell portion are joined to form said ink container.

2. An ink container in accordance with claim 1, wherein said ink container has a stepped portion, at which said ink container is substantially divided into the first shell portion and the second shell portion.

3. An ink container in accordance with claim 1, wherein the roughness of the internal surfaces of the first shell portion and the second shell portion which form the spaces for accommodating the corresponding porous member portions is no less than 35S and no more than 560S.

4. An ink container in accordance with claim 1, wherein an ink delivery member is disposed in said ink supplying portion.

5. An ink container in accordance with claim 1, wherein the first and second porous members are contacted to each other compressedly at an interface therebetween.

* * * * *

UNITED STATES PATENT AND TRADEMARK OFFICE

CERTIFICATE OF CORRECTION

PATENT NO. : 5,839,595

DATED : November 24, 1998

INVENTOR : Toshihiko Ujita

It is certified that error appears in the above-identified patent and that said Letters Patent is hereby corrected as shown below:

COVER PAGE

Under [56] References Cited, U.S. Patent Documents, please insert the following:

| | | |
|---|---|---|
| --5,025,271 | 6/18/91 | Baker, et al. |
| 5,280,299 | 1/18/94 | Saikawa et al.-- |

Under [56] References Cited, Foreign Patent Documents, please insert the following:

| | | |
|---|---|---|
| --580433 | 1/26/94 | Europe |
| 581531 | 2/2/94 | Europe |
| 2-34351 | 2/5/90 | Japan |
| 6-40043 | 2/15/94 | Japan |
| 7/25024 | 1/27/95 | Japan |
| 2305397 | 4/09/97 | Great Britain -- |

COLUMN 3

Line 54, "tile" should read --the--; and
Line 56, "1 like" should read --like--.

COLUMN 4

Line 56, "i s" should read --is--.

UNITED STATES PATENT AND TRADEMARK OFFICE

CERTIFICATE OF CORRECTION

PATENT NO. : 5,839,595

DATED : November 24, 1998

INVENTOR : Toshihiko Ujita

It is certified that error appears in the above-identified patent and that said Letters Patent is hereby corrected as shown below:

COLUMN 6

Line 26, "invention" should read --invention.--.

Signed and Sealed this

Thirteenth Day of July, 1999

*Attest:*

*Attesting Officer*

Q. TODD DICKINSON

*Acting Commissioner of Patents and Trademarks*